US007721380B2

(12) United States Patent
Libman et al.

(10) Patent No.: US 7,721,380 B2
(45) Date of Patent: May 25, 2010

(54) PUSH BROOM BRACKET

(75) Inventors: Robert J. Libman, Arcola, IL (US); Marco Bizzotto, Padua (IT); Fernando Santos, Maceira LRA (PT)

(73) Assignee: The Libman Company, Arcola, IL (US)

( * ) Notice: Subject to any disclaimer, the term of this patent is extended or adjusted under 35 U.S.C. 154(b) by 0 days.

(21) Appl. No.: 11/555,667

(22) Filed: Nov. 1, 2006

(65) Prior Publication Data

US 2007/0226930 A1 Oct. 4, 2007

Related U.S. Application Data

(60) Provisional application No. 60/732,484, filed on Nov. 2, 2005.

(51) Int. Cl.
*A46B 3/08* (2006.01)

(52) U.S. Cl. ..... 15/175; 15/159.1; 15/146

(58) Field of Classification Search ..... 15/175, 15/159.1, 143.1, 146; 16/440, 422; 403/342, 403/343, 256, 261, 263, 187, 189
See application file for complete search history.

(56) References Cited

U.S. PATENT DOCUMENTS 2,893,034 A * 7/1959 Jones ..... 15/146
4,239,413 A * 12/1980 Wludyka ..... 403/263
4,541,139 A * 9/1985 Jones et al. ..... 15/171
5,094,564 A * 3/1992 Tedrick ..... 403/373
5,161,278 A * 11/1992 Tomm ..... 15/159.1
5,172,447 A * 12/1992 Tomm ..... 15/159.1
5,337,440 A * 8/1994 Vosbikian et al. ..... 15/143.1
5,551,115 A * 9/1996 Newville ..... 15/172
D382,117 S * 8/1997 Uranga et al. ..... D4/132
5,772,354 A * 6/1998 Finn ..... 403/262
5,774,922 A * 7/1998 Bumb ..... 15/159.1
5,890,254 A * 4/1999 Courtney et al. ..... 15/145
6,134,739 A * 10/2000 Gonzalez ..... 15/175
6,594,850 B2 * 7/2003 Libman et al. ..... 15/145
2003/0180085 A1 * 9/2003 Hughes ..... 401/289

* cited by examiner

*Primary Examiner*—Dung Van Nguyen
(74) *Attorney, Agent, or Firm*—Banner & Witcoff, Ltd.

(57) ABSTRACT

A cleaning apparatus includes a bracket assembly for securely attaching a handle to a block. The bracket assembly aids in securing the handle in a fixed position during use so that the handle will not loosen and/or disengage with use. The bracket assembly may include one or more flanges for engaging multiple sides of the block. The handle and the bracket assembly may be configured to allow the handle to be reversed so that it extends first from the back face of the block and then from the front face of the block.

19 Claims, 8 Drawing Sheets

PUSH BROOM BRACKET

This application claims priority to U.S. Provisional Application Ser. Nos. 60/732,484 filed Nov. 2, 2005, which is incorporated herein by reference in its entirety.

FIELD OF THE INVENTION

The embodiments of the present invention relate to push brooms and similar cleaning implements. More particularly, the various embodiments relate to a bracket assembly for removably yet securely connecting a handle to a push broom head.

BACKGROUND OF THE INVENTION

Brooms sometimes are classified as either "push" brooms or "upright" brooms. Upright brooms are often wide and generally have relatively long bristles, typically extending from a shroud or broom head. An elongated handle having a central longitudinal axis aligned with the bristles may facilitate side-to-side sweeping of the upright broom. An end of the handle may be permanently secured within an opening in the broom head.

Push brooms generally have relatively short bristles, which may be set in a wide block, or broom head. The broom head may have a generally rectangular shape. An elongated handle may extend upwardly from the broom head and be set at an angle to facilitate pushing the broom, with a long side of the broom head facing in the direction of sweeping. Push brooms often have detachable handles. A detachable handle, among other benefits, facilitates shipping of the brooms. Additionally, depending on the configuration of the broom head, a detachable handle can permit the handle to be mounted on the broom head in the opposite direction, and thus allow sweeping in reverse direction to prolong the life of the bristles.

Conventionally, detachable handles are connected to broom heads by screwing a threaded end of the handle into a threaded aperture in the broom head. For some time, it has been known that, with such brooms, the handle has a tendency to rotate and loosen during use. Various efforts have been made to avoid this and other problems.

U.S. Pat. No. 4,194,259 discloses an industrial push broom that includes an attachment means for connecting the handle to the back of the push broom. A first flange of the attachment means is fastened to the top face of the broom, and a second flange is fastened to the rear edge of the broom. The handle extends from the intersection of the rear edge and the top face. The positioning of the attachment means is fixed with respect to the back of the broom.

U.S. Pat. No. 5,094,564 discloses a brush block assembly with latching means for maintaining the handle in an interlocked position. One end of the handle extends into a hole in the broom block. The positioning of the brush block assembly is fixed with respect to the broom block.

There remains a need for improved features for a bracket assembly for a push broom to facilitate removal of the handle from the broom head when desired but otherwise maintain the handle securely connected to the broom head.

SUMMARY OF THE INVENTION

A push broom having a bracket assembly for securely attaching a handle to a broom head provides a strong and durable push broom. The bracket assembly secures the handle in a fixed position during use so that the handle will not loosen with use. The bracket assembly also provides reinforcement for the handle and stabilizes the handle relative to the broom block. The connection assembly also allows the position of the handle to be reversed to extend first from the back face of the broom head and then from the front face of the broom head. Reversing the position of the handle enables the bristles along the back face of the broom head to be moved to the front and utilized for sweeping, which can be useful when the bristles along the front face of the broom head become worn or bent. The bracket assembly also is reusable and allows replacement of the handle and broom head separate from one another when needed.

The resulting push broom is simple to manufacture and easier to assemble, disassemble, and reassemble than previously-known brooms. Further advantages of the invention should be apparent to those skilled in the art upon reviewing the following detailed description in conjunction with the accompanying drawings.

BRIEF DESCRIPTION OF THE DRAWINGS

In the detailed description which follows, reference will be made to the drawings comprised of the following figures.

DETAILED DESCRIPTION OF THE PREFERRED EMBODIMENTS

Figure 1:
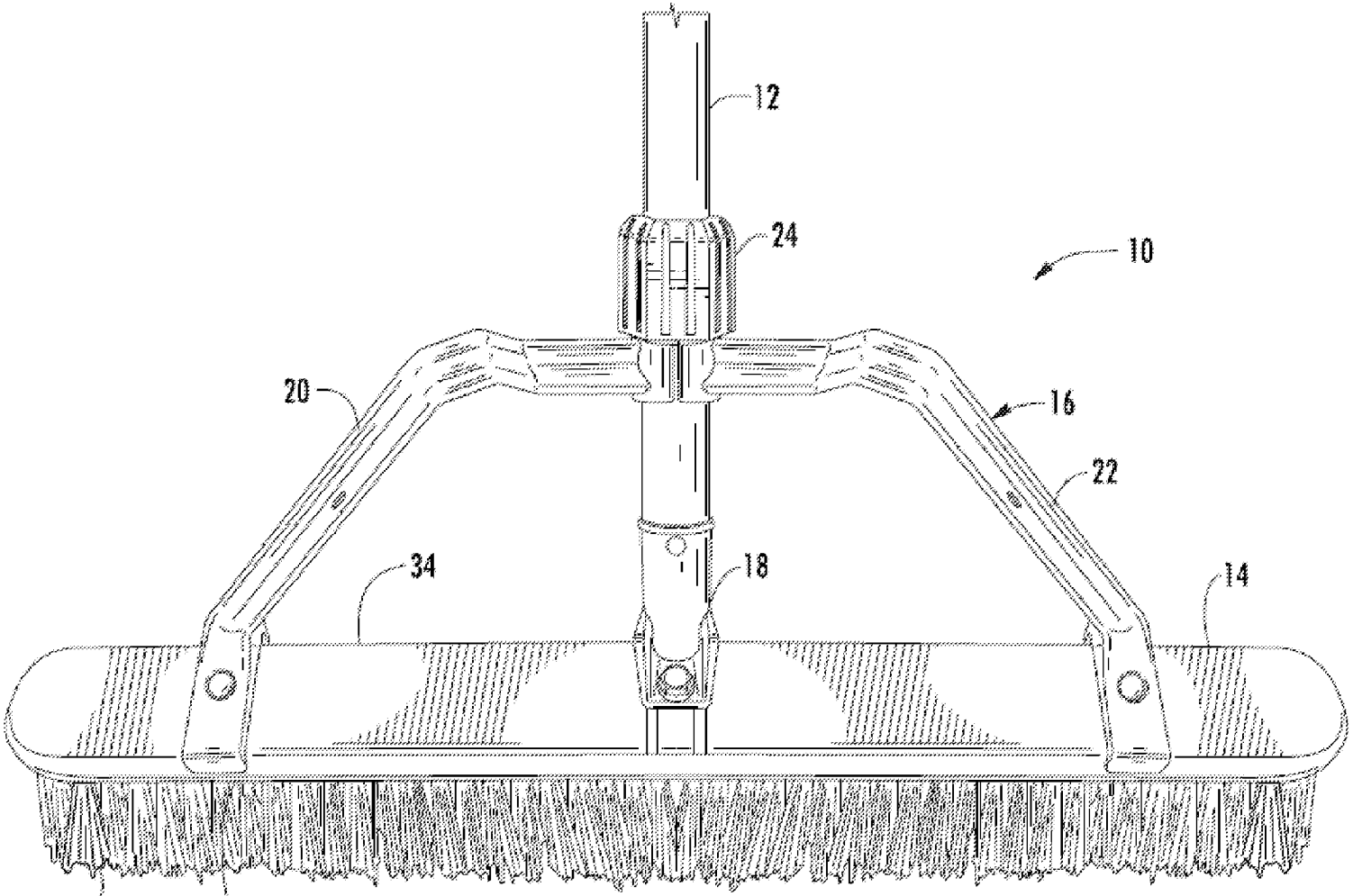
FIG. 1 is a top perspective view of a portion of a push broom, including a push broom block, a handle and a bracket assembly, in accordance with an embodiment of the invention, showing the locking nut in the assembled position.
Figure 2:
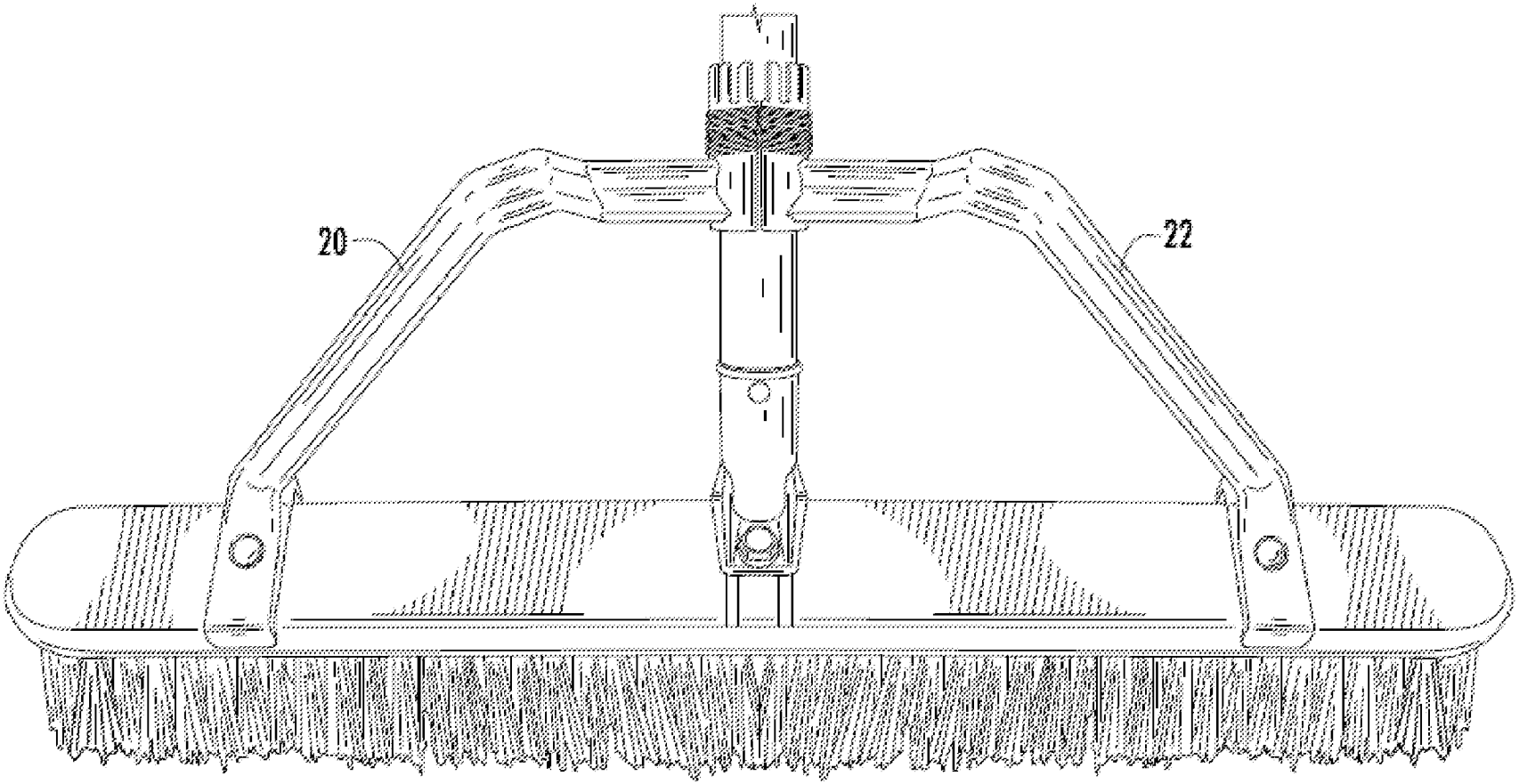
FIG. 2 is a top perspective view of the portion of the push broom of FIG. 1, showing the bracket assembly without the locking nut in assembled position.
Figure 3:
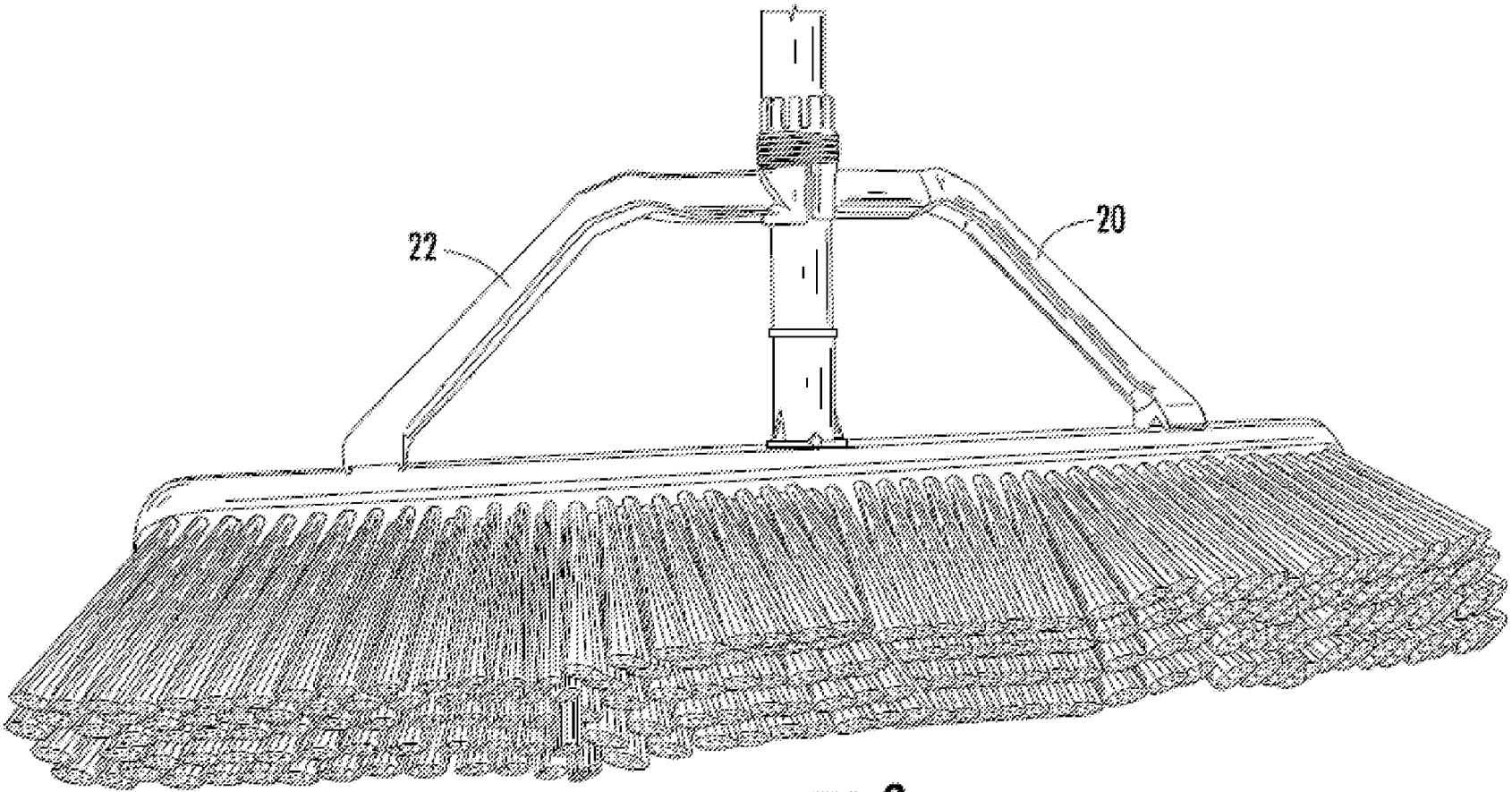
FIG. 3 is a bottom perspective view of the push broom of FIG. 2.

Referring to FIGS. 1-3, a push broom 10 is shown. The push broom 10 generally includes an elongated handle 12, a broom block 14 and bracket assembly 16 to connect the handle 12 to the broom head 14. The handle 12 includes a perimeter that, in operation, allows a user to grip the handle 12 and use the push broom 10. Although the connection assembly is shown and described herein with respect to a push broom, the connection assembly also could be used with other cleaning implements that include a block and are pushed forward and pulled back during use, including mops, dusters, sweepers and the like, and such use is contemplated as being within the scope of the invention.

The broom block 14 is depicted as being substantially rectangular. Blocks can come in a variety of shapes and sizes and, in general, allow fibers and bristles and the like to the coupled to a handle in a secure manner while providing an increased surface area for supporting the fibers and bristles and such. The handle 12 can be connected to the broom block 14 by connection assembly 18 or by any other method known to those of skill in the art. While any method may be used, it is noted that certain embodiments are more suitable to the use of a fastening mechanism that is removable, thus such an embodiment may not be suited for the use of relatively permanent fastening techniques such as welding, adhesives or the use of rivets and the like.

The handle 12 can be made of any conventional material (such as plastic, metal, or wood) and have any conventional or convenient length and configuration. Although the illustrated handle is straight, it could also have one or more bends or curves for added convenience or ease of use and have a different length and diameter. It could also have a shaped handgrip or hanger tip at the distal end (not shown).

The broom block 14 includes a plurality of bristles 32 for sweeping. The bristles 32 can be of any desired length and density and can be of a natural or man-made composition, including but not limited to natural hairs, natural fibers, polymeric or other synthetic fibers and metallic bristles. The bristles 32 can be mounted to the bottom surface of the broom block 14 in any convenient or conventional way.

Looking at FIGS. 4-7, the bracket assembly 16 includes first and second bracket pieces 20 and 22 and locking nut 24. Each bracket piece 20, 22 includes a curved receiving end 26 shaped to fit about the handle 12 and a mounting end 28 that attaches to the broom block 14. As can be appreciated, in an embodiment, the receiving end 26 may be circular-shaped so as to securely engage a circular-shaped handle 12.

In certain embodiments, the bracket pieces 20, 22 may be generally straight. In other embodiments, the bracket pieces 20, 22 may be angled. For example, they can extend out from the handle 12 at a first angle (such as 90 degrees with respect to the handle) and then extend at a second angle (such as about 45 degrees with respect to the handle) toward the broom block 14, forming a bracket that may provide greater rigidity than a bracket extending directly between the curved receiving ends 26 and the mounting ends 28. Thus, the bracket piece has an angle of about 135 degrees. Larger and smaller angles also are contemplated, and may range, for example, between about 95 and 180 degrees. As can be appreciated, the angle of the bracket piece 20, 22 allows forces exerted on the handle to be transferred to the broom block 14.

Figure 4:
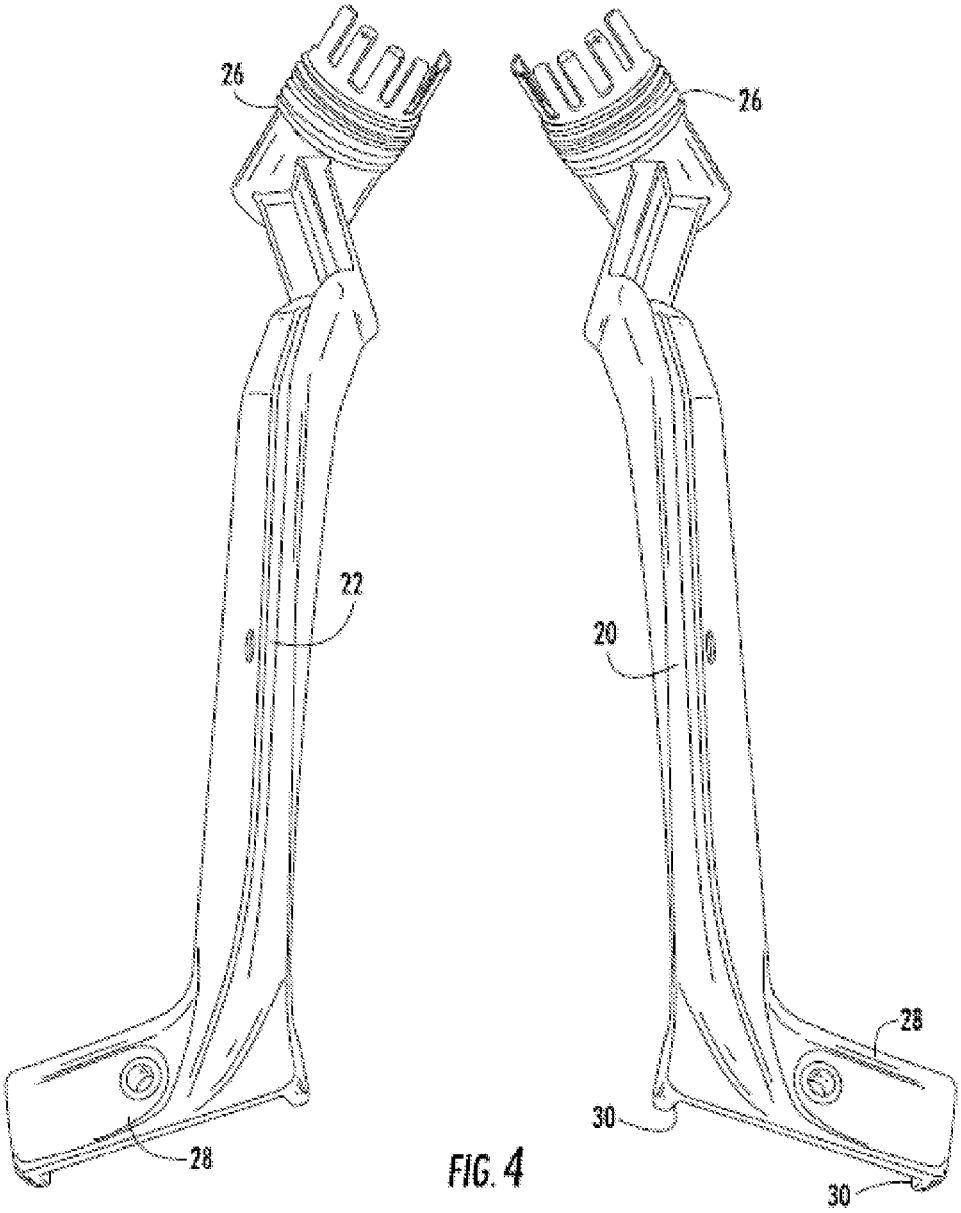
FIG. 4 is a top perspective view of the bracket assembly of the push broom of FIG. 1, showing the disassembled two bracket pieces.
Figure 5:
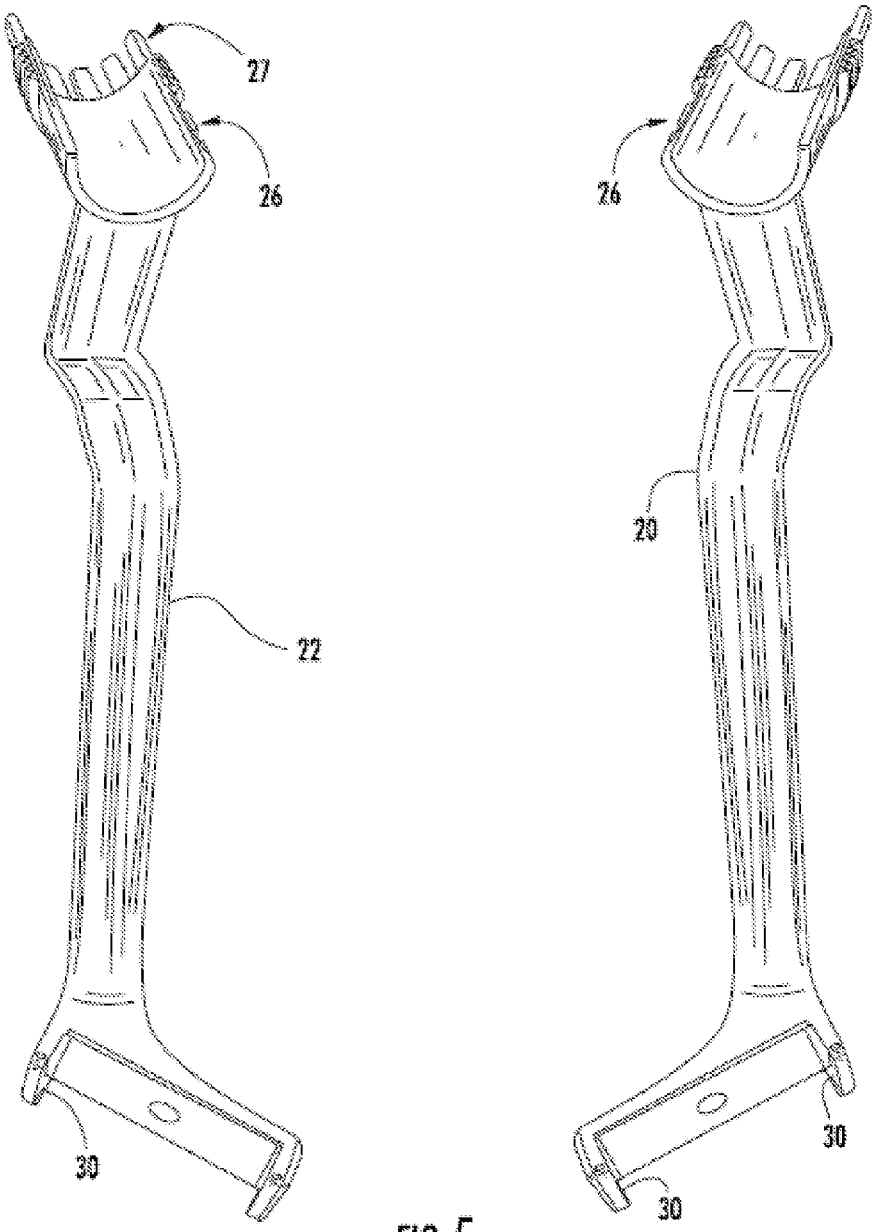
FIG. 5 is a bottom perspective view of the bracket pieces of the bracket assembly of FIG. 4.
Figure 6:
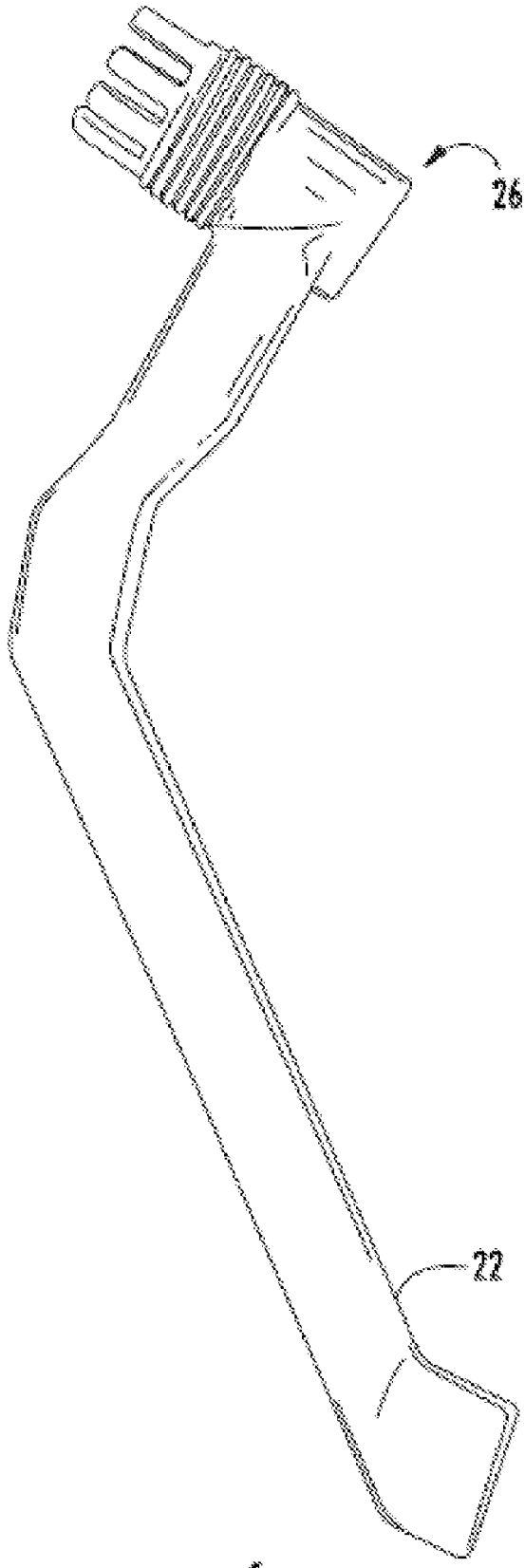
FIG. 6 is a side view of one of the bracket pieces of FIG. 5.

The mounting end 28 may include a flange 30 at one or both ends of the mounting end 28 to fit about the front and rear edges 32 and 34 of the broom block 14 and further enhance the stability of the assembly. The flange 30, if provided, can extend along an additional side (or sides if two flanges 30 are provided) of the broom block 14 and allow the bracket pieces 20, 22 to press against additional sides of the broom block 14 so as to provide greater support and resistance to bending and rotational moments exerted on the handle 12. As can be appreciated from FIG. 5, if two flanges 30 are provided, the mounting ends 28 can provide a concave mounting surface, which can be square shape as depicted or more rounded, depending on the face of the broom block 14. This can provide a more reliable assembly and robust assembly and lessen the possibility that the handle 12 will, for example, rotate with respect to the broom block 12 regardless of how the handle 12 is attached. To further provide strength while minimizing weight, the bracket pieces 20, 22 may include a substantially U-shaped cross-section as depicted in FIG. 4.

Figure 7:
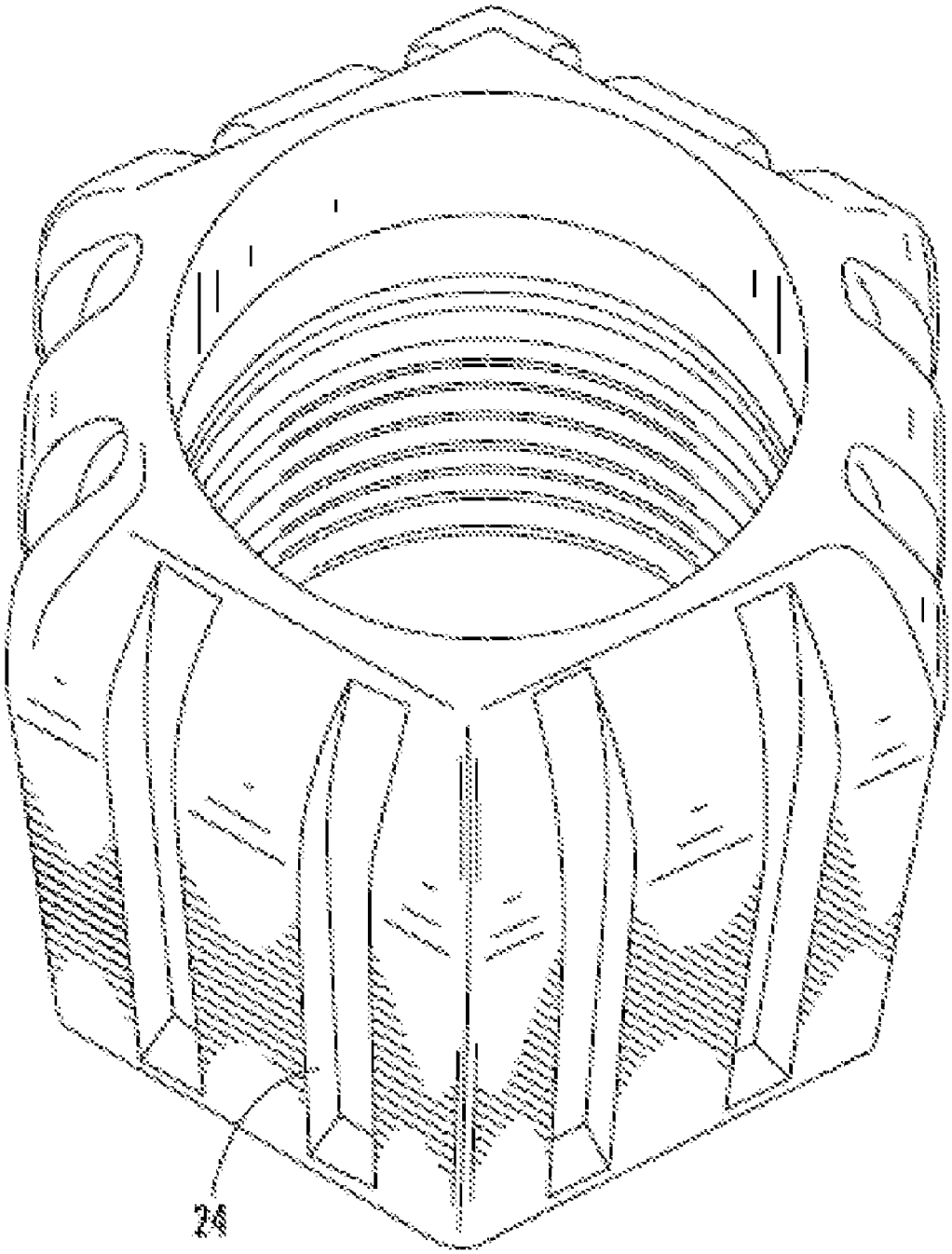
FIG. 7 is an enlarged top perspective view of the locking nut of FIG. 1.
Figure 8:
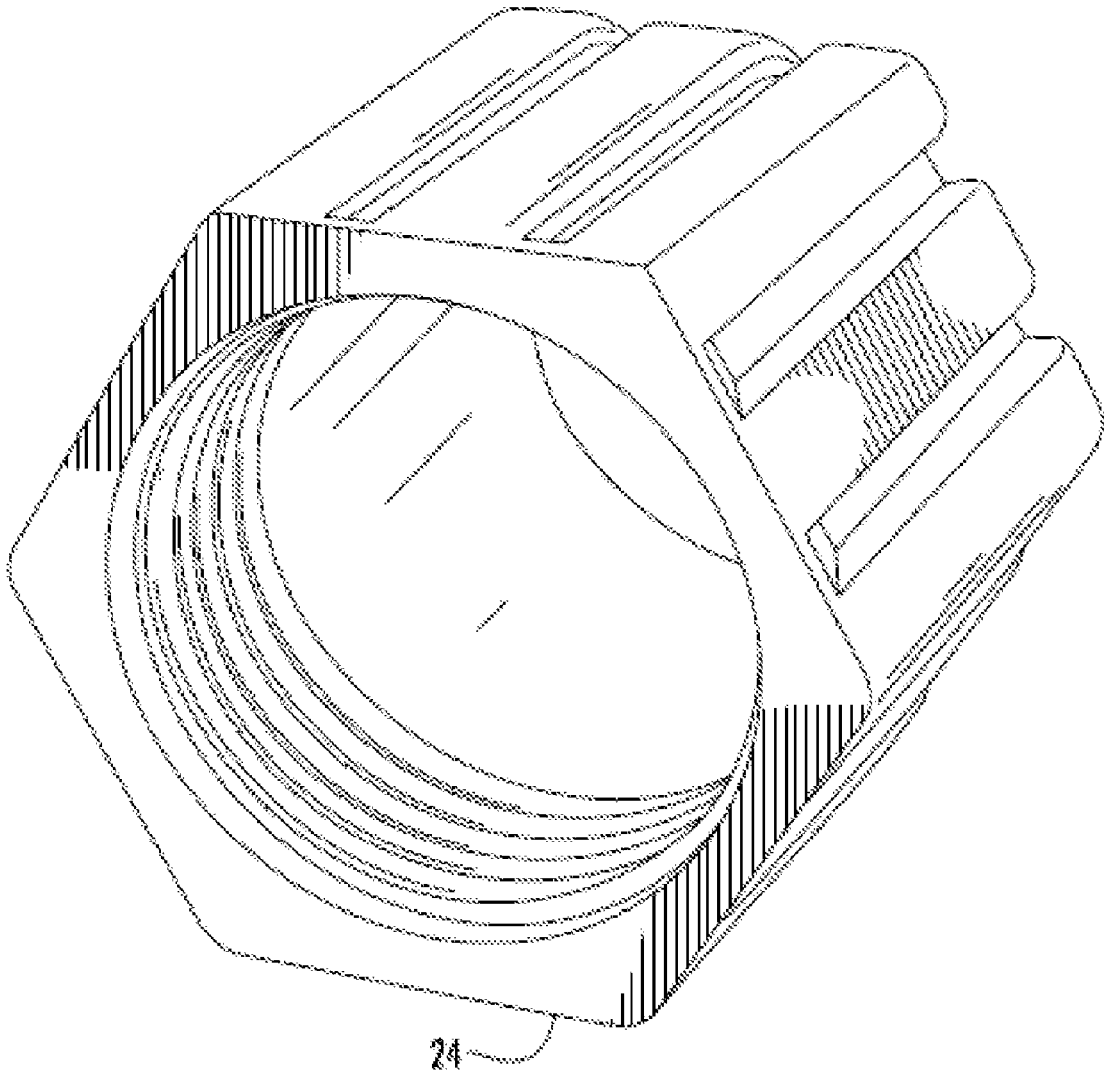
FIG. 8 is a side perspective view of the locking nut of FIG. 7.

As illustrated in FIG. 2, for example, the bracket pieces 20 and 22 are positioned on either side of the handle 12. Mounting ends 28 are fastened to the broom block 14 using any suitable fastener. For example, without limitation, a screw, with or without a corresponding nut may be used so that the mounting ends 28 can be readily fastened and unfastened to the broom block 14. If the ability to unfasten the mounting ends 28 is not desired, then other known fastening means such as welding, rivets, adhesives and the like may be used. Once positioned around the handle 12, receiving ends 26 are secured to the handle 12 by sliding locking nut 24 over and about the receiving ends 26. As the locking nut 24 slides over the receiving ends 26, they surround and grip the handle 12. Receiving ends 26 may include inwardly-directed gripping elements such as fingers 27 (FIG. 5) or similar features to engage the handle 12. A threaded connection, such as on the exterior of the receiving ends 26 and the interior of the locking nut 24 (FIG. 8), may secure the locking nut 24 in position around the receiving ends 26. In certain embodiments, the locking nut 24 shrouds at least the end portion of the receiving ends 26 and the tightening of the locking nut 24 may cause the inwardly-directed gripping elements to be pressed toward the handle 12. The locking nut 24 may also be rounded on one end (FIG. 7). This has the benefit of providing a clean, aesthetically please appearance while protect the user from inadvertently scraping a hand on the gripping elements. Bracket pieces 20, 22, as well as the locking nut 24, can be fabricated of metal, molded polymeric material or other strong, durable material.

The present invention has been described in terms of preferred and illustrative embodiments thereof. Numerous other embodiments, modifications and variations within the scope and spirit of the appended claims will occur to persons of ordinary skill in the art from a review of this disclosure.

We claim:

1. A bracket assembly for supporting a handle mounted on a broom block, comprising:

two arms, each arm having an inwardly curved surface end shaped to fit about a handle and a mounting end for releasably engaging a broom block, wherein the curved surface ends include a plurality of inwardly-directed gripping elements; and a lock nut for releasably securing the curved surface ends together so as to, in operation, securely grip the handle with the two curved surface ends; and wherein the handle is fixed to the block via a connector assembly that is spaced apart from the mounting ends of the two arms.

2. The bracket assembly of claim 1, wherein the two arms are substantially identical.

3. The bracket assembly of claim 1, wherein each of the curved surface ends of the two arms includes a partial external thread and the lock nut is configured to engage the partial external thread of the curved surface end of the two arms so as to, in operation, secure the two arms to the handle.

4. The bracket assembly of claim 1, wherein the curved surfaces are concaved surfaces, whereby each of the curved surfaces partially wraps around the handle when installed.

5. An apparatus for cleaning, comprising:

a block, the block including a first side, a second side, a third side, and a fourth side;

a handle removably mounted to the block;

a bracket assembly including two arms that include a proximal and a distal end, the proximal end having an inwardly curved surface shaped to fit about a portion of the handle and the distal end engaging the block, the bracket assembly removably mountable to the handle and the block, wherein the distal end of each of the two arms includes a mounting surface and a first flange, wherein the distal end of each of the two arms engages both the first and second sides of the block; and a fastener for securing the bracket assembly to the handle.

6. The apparatus of claim 5, wherein the block is a substantially rectangular shaped broom block.

7. The apparatus of claim 5, wherein the distal end of each arm of the bracket is configured to be mounted to the block with a fastener.

8. The apparatus of claim 5, wherein the distal end of each of the two arms includes a second flange, wherein the distal end further engages the third side of the block and the third side extends along a top surface of the block.

9. The apparatus of claim 5, wherein the bracket assembly comprises two arms that are substantially identical, the two arms being assembled in a mirrored position.

10. The apparatus of claim 5, wherein the distal end of the two arms has a concave portion, and wherein the two arms help improve the transfer of forces from the handle to the block.

11. The apparatus of claim 5, wherein the handle includes a perimeter and the proximal end of the two arms are shaped to allow the bracket assembly to engage a portion of the perimeter of the handle.

12. The apparatus of claim 11, wherein the proximal end of the two arms include half-circular shaped portions for engaging the perimeter of the handle.

13. The apparatus of claim 12, wherein the half-circular shaped portions of the arms include external threads and the fastener is a nut configured to fit over the handle and removably secure the proximal ends of the two arms to the handle.

14. The apparatus of claim 5, wherein the fastener is a nut configured to extend over the handle and secure proximal ends of the arms to the handle, the nut including a first end and a second end, wherein the second end is rounded.

15. The apparatus of claim 5, wherein the handle is configured to be mounted to the block in a first and a second orientation.

16. An apparatus for cleaning, comprising:

a block;

a handle;

a connector assembly securing the handle to the block, the connector assembly being configured to mount the handle in a first and a second orientation with respect to the block;

a bracket assembly including two arms that include a proximal and a distal end, the proximal ends having a surface shaped to fit about a portion of the handle and the distal ends engaging the block, wherein the bracket assembly is removably mountable to the handle and the block; and a nut configured to rotate about the handle and to engage and secure the shaped surfaces of the proximal ends of the arms to the handle; and wherein the distal end of the two arms of the bracket assembly is U-shaped and configured to be removably mounted to the block with a fastener.

17. The apparatus of claim 16, wherein the proximal end of the two arms is circular shaped and configured to engage the handle.

18. The apparatus of claim 17, wherein the two arms include external threads and the nut is configured to slide over the handle and engage the external threads of the two arms.

19. The apparatus of claim 16, wherein the two arms further comprise a first portion extending from the handle at a first angle and a second portion extending from the first portion at a second angle.

* * * * *